US005092402A

United States Patent [19]

Perricone et al.

[11] Patent Number: 5,092,402

[45] Date of Patent: Mar. 3, 1992

[54] TUBING END LOCATOR

[75] Inventors: James M. Perricone, Spring; John T. Lembcke, Houston, both of Tex.

[73] Assignee: Petro-Tech Tools Incorporated, Houston, Tex.

[21] Appl. No.: 556,563

[22] Filed: Jul. 20, 1990

Related U.S. Application Data

[63] Continuation-in-part of Ser. No. 551,855, Jul. 12, 1990, abandoned.

[51] Int. Cl.[5] ..... E21B 47/09

[52] U.S. Cl. ..... 166/113; 166/64; 166/255

[58] Field of Search ..... 166/64, 113, 255, 241

[56] References Cited

U.S. PATENT DOCUMENTS

| | | | |
|---|---|---|---|
| 2,999,542 | 9/1961 | Myers | 166/64 |
| 3,061,010 | 10/1962 | Conrad et al. | 166/64 |
| 3,381,750 | 5/1968 | Brown | 166/64 |
| 3,696,865 | 10/1972 | Chapman | 166/255 |
| 3,888,306 | 6/1975 | Wetzel | 166/255 |
| 4,067,386 | 1/1978 | Weise | 166/255 |

OTHER PUBLICATIONS

Tri-State Oil Tools, Inc., A Baker Hughes Company, "Tri-State Tail Pipe Locating Tool", (no date).

Petro-Tech Tools, Inc., "Coiled Tubing Type Tubing End Locator", May 1989.

*Primary Examiner*—Terry Lee Melius

*Attorney, Agent, or Firm*—Vaden, Eickenroht, Thompson & Boulware

[57] ABSTRACT

A tubing end locator is disclosed having a mandrel and a collet carried by the mandrel. The collet has an annular base and a plurality of fingers having one end attached to the base and a free end extending from the base along the mandrel in parallel, spaced relationship. A beveled lug is carried by the free end of each finger. A flange on the mandrel has a diameter such that the lugs on the fingers will extend beyond the inside diameter of the tubing when the free ends of the fingers are in engagement with the flange. Means hold the fingers in engagement with the flange and resist the re-entry of the fingers into the tubing after the tubing end locator has passed out of the tubing until a substantial upward force has been exerted on the mandrel thereby giving a surface indication that the tool had engaged the lower end of the tubing.

5 Claims, 4 Drawing Sheets

TUBING END LOCATOR

This is a continuation-inpart of application Ser. No. 07/551,855 filed on 07/12/1990, now abandoned, and entitled "Tubing End Locator". This invention relates to a tool for locating the end of a string of tubing or a restriction or a recess in a string of tubing.

When working over a well through the tubing production string using coil tubing, it is often important to know where the end of the well tubing is located in the well bore. It is an object of this invention to provide an improved tool for accomplishing this. It is a common feature of all tubing end locators that some type of cam member or spring-loaded latch member must be forced to a retracted position as the tool is moved through the well tubing so that these devices will move outwardly when the tool passes through the end of the well tubing. Various arrangements are used to require a substantial upward pull on the locator before the locator can re-enter the well tubing and be brought back to the surface. The fact that it takes a substantial amount of upward pull on the locator to accomplish this is the indication that the locator was indeed in engagement with the open end of the well tubing.

Some locators use spring-loaded arms that move outwardly to engage the bottom of the tubing and are held in this position by shear pins. The upward force required to shear the pins and allow the arms to pivot downwardly into position to re-enter the tubing is the indication that the arms were in engagement with the bottom of the tubing. These locators cannot be used again until they have been pulled from the tubing and the shear pins replaced.

The locators that use spring-loaded cam members can be pulled into the tubing, then lowered again to a position to engage the bottom of the tubing to check again the amount of force required to force the cam members inwardly far enough to enter the tubing. This procedure allows the first indication to be confirmed. Once collapsed and inside the tubing, the spring-loaded cam members will continue to exert an outward force against the inside wall of the well tubing thereby increasing the force required to move the locator through the well tubing and increasing the wear on the parts of the locator and the well tubing itself.

Therefore, it is an object of this invention to provide a tubing end locator that employs spring-loaded cam members that exert very little force on the wall of the tubing as the tool moves through the tubing in both directions.

It is a further object of this invention to provide a tubing end locating tool in which a collet is mounted on a mandrel for movement along the mandrel to position lugs carried by the free ends of the collet fingers either to move inwardly far enough to re-enter the tubing with little or no force exerted thereon or to be held against such movement until a substantial upward force is exerted on the mandrel.

It is a further object of this invention to provide such a tubing end locator in which the collet is held against moving to a position to allow the fingers to re-enter the tubing by engaging surfaces on the collet and mandrel.

It is a further object of this invention to provide such a tubing end locator in which the collet is held against moving to a position to allow the fingers to re-enter the tubing by a spring.

It is a further object of this invention to provide such a locating tool where the force required to move the tubing end engaging cam members to a position for re-entry into the tubing is dependent upon the position of the members on the tool's mandrel and not on the spring force urging them outwardly into a position to engage the end of the tubing.

It is a further object and feature of this invention to provide a tubing end locating tool in which a collet is mounted on a mandrel for movement along the mandrel to position lugs or cam members carried by the free end of the fingers of the collet, either to move inwardly with little or no force exerted thereon or to be held against such movement by the mandrel itself resulting in only the vertical component of the upward pull on the tool being transmitted to the means holding the fingers in such position on the mandrel which results in a substantially uniform upward force being required to release the holding means to allow the collet to move to a position where the free ends of the collet fingers can move inwardly and enter the tubing string.

These and other objects and features of this invention will be apparent to those skilled in the art from a consideration of this specification, including the attached drawings and appended claims.

The locating tool of the invention is shown in the drawings and described below as it operates to locate the end of a string of tubing. It will operate in the same manner to locate a recess or restriction in the string and the same advantages set out above in the objects of the invention will apply equally.

IN THE DRAWINGS

Figure 1:
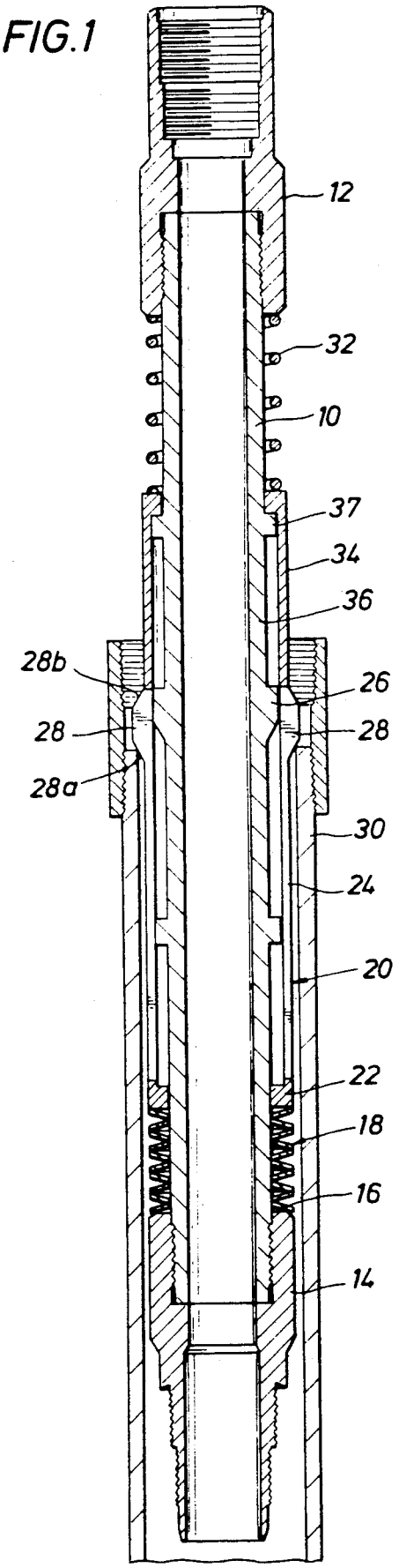
FIG. 1 is a cross-sectional view of one embodiment of the locator of this invention showing the relative position of the elements thereof as the locator is just entering the well tubing at the surface.

The tool of FIGS. 1–4 consists of mandrel 10, which is usually made up of various sections but for simplicity in the drawings is shown as one piece. The mandrel is connected to sub 12, which in turn is connected to the end of the tubing (not shown) that is used to run this tool into and out of the well tubing of an oil or gas well. The lower end of the mandrel is connected to lower sub 14 that provides upwardly facing shoulder 16 and a connection to tools run below the locator.

Resting on shoulder 16 are resilient means that in this embodiment comprises a plurality of Bellville washers, generally indicated by the number 18. Located above the washers on the mandrel is collet 20. The collet includes annular base member 22 to which fingers 24 have one end attached. The free end of each finger extends upwardly along the side of the mandrel to a position opposite the outer surface of ring or flange 26. Flange 26 is a section of the mandrel of increased diameter and is generally arranged so that fingers 24, in the position shown in FIG. 1, are not stressed in any manner but are generally straight as shown.

The free ends of all the fingers are provided with cam members or lugs 28. These lugs are wider than the fingers themselves and extend outwardly away from the fingers sufficiently so that when the lugs are in the position shown in FIG. 1, they cannot enter well tubing 30. The lugs are all beveled as shown, having one bevel 28*a* on the lower side and 28*b* on the upper side of the lug. In FIG. 1, the lower bevel is in engagement with the upper end of tubing 30. Coil spring 32 through sleeve 34, which engages the upper end of the fingers, resists the upward movement of the fingers from the position shown in FIG. 1. Downward force, however, will cause spring 32 to be compressed, allowing tubing 30 and the fingers to move upwardly where they can move inwardly into the annular space provided by section 36 of the mandrel, which is a section of reduced diameter between flanges 26 and 37. The end of tubing 30 acting on beveled edge 28*a* of the lugs urges the lugs to move into the space between the flanges, as shown in FIG. 2. The tool can now move downwardly through the well tubing with the lugs exerting a force on the wall of the tubing equal to the force required to move the lugs into the space between flanges 28 and 37, which is very little.

Figure 2:
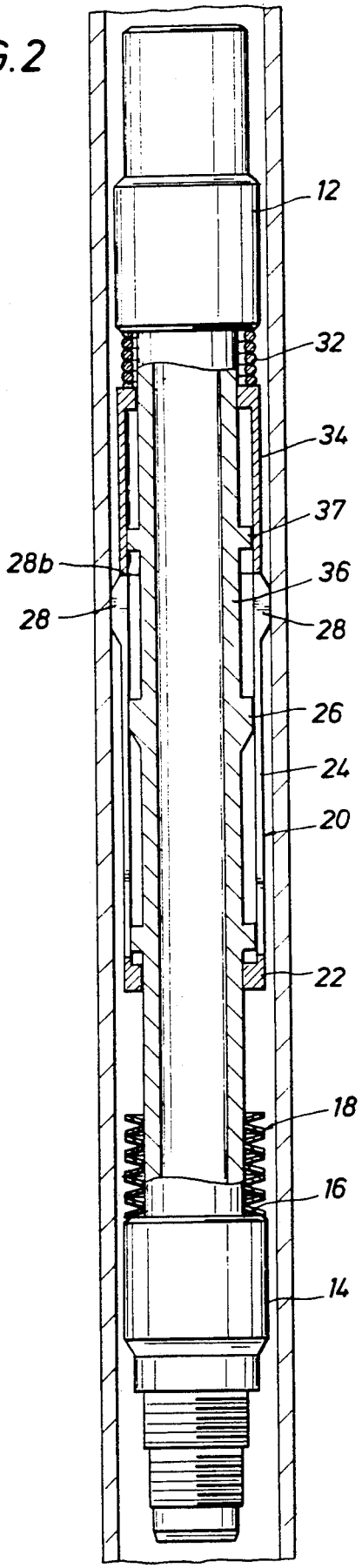
FIG. 2 shows locator tool of FIG. 1 with the elements thereof in the position they are in as the tool moves downwardly in the well tubing toward its lower end.
Figure 3:
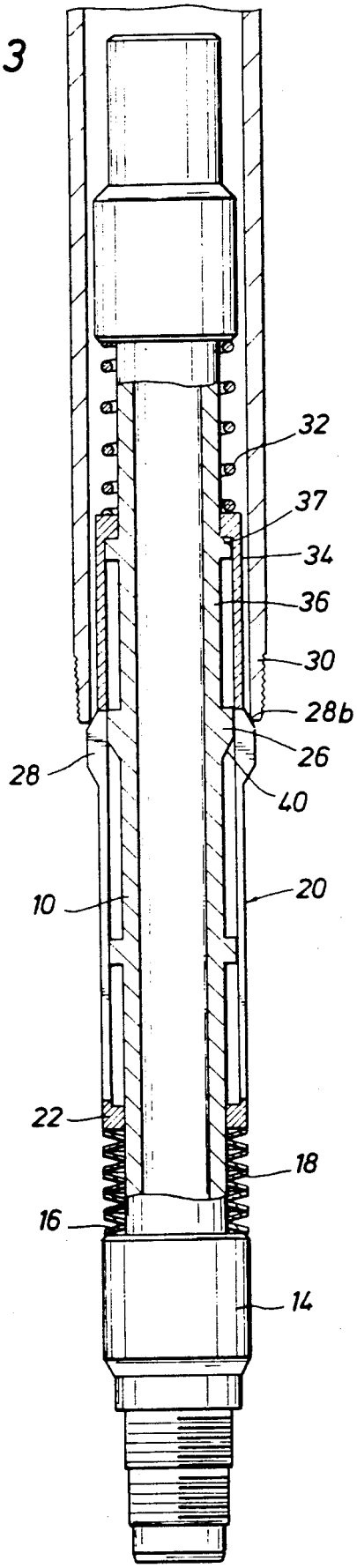
FIG. 3 shows the condition of the tool after it has passed through the open end of the well tubing and its cam members are in engagement with the lower end of the tubing.

When the tool passes out of the tubing, spring 32 and sleeve 34 will push the lugs and the fingers back to the position shown in FIG. 1. Upward movement of the tool will now move beveled edge 28*b* of the lugs into engagement with the lower end of well tubing 30, as shown in FIG. 3. The lower outside edge of most all pin connections have a small, about ¼ inch, chamfer or bevel to break the sharp edge produced when the joint is made. Usually, the bevel is at about 30°.

This is the angle of chamfer on lugs 28. An upward pull on the tool will now cause the lower end of the well tubing to exert a force on the lugs urging them downwardly and inwardly. This movement is resisted by Bellville washers 18 and flange 26 so only the vertical component of the total force exerted on the engaging surfaces is available to compress the Bellville washers. Knowing the angle of the bevels of the pipe and the lugs and knowing the spring rate of the Bellville washers, the force required to compress the Bellville washers and allow the lugs to move to the position shown in FIG. 4 can be calculated.

Figure 4:
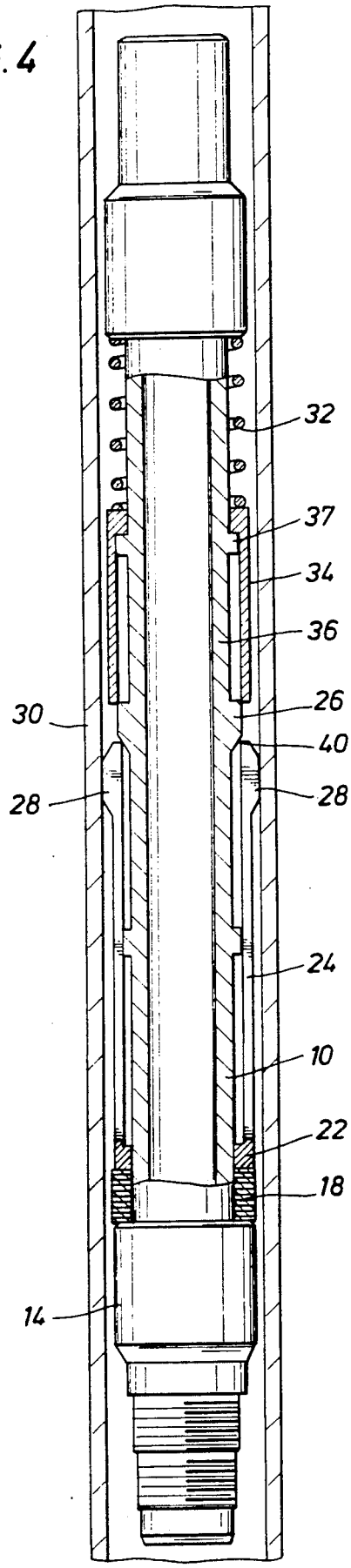
FIG. 4 shows the position of the various elements of the locator after the tool has been pulled back into the tubing.

In FIG. 4, the Bellville washers have been compressed. The lugs on the end of the fingers have moved downwardly below flange 26, where they can move inwardly and allow the tool to re-enter the tubing. Once inside the tubing, they cannot move back to a position over the flange and are held in the position shown in FIG. 4 by the inner wall of the tubing as the tool is pulled out of the well tubing. By making the angle of the conical surface 40 between flange 26 and the mandrel relatively flat, the component of the force exerted by the spring urging the lugs against the inside wall of the pipe can be reduced to a minimum.

Figure 8:
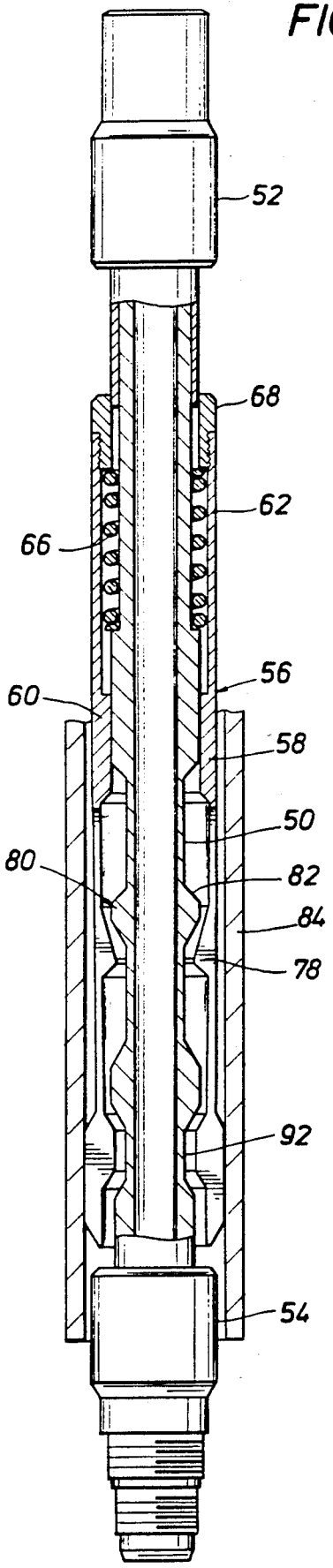

The alternate embodiment of the tubing end locator of this invention shown in FIGS. 514 8 includes mandrel 50, which is connected at its upper end to sub 52. The sub is provided with the required threads for attaching the sub and the mandrel to the tubing that will be used to move the tool through the well production tubing the lower end of which it is to locate. The lower end of the mandrel is connected to sub 54 that can be used to connect any tools that may be run in the string below the tubing end locator.

Mounted on the outside of the mandrel for longitudinal movement relative to the mandrel is collet 56. The collet includes cylindrical section or base member 58 that has an inside diameter just slightly larger than the outside diameter of section 60 of the mandrel to guide the collet along the longitudinal axis of the mandrel as the collet moves longitudinally relative to the mandrel.

The collet also includes upper cylindrical section 62. The inside surface of this section is spaced from the outside diameter of the mandrel to provide annular chamber 64 in which coil spring 66 is located. The lower end of the coil spring is attached to section 58 of the collet and the upper end is connected to sleeve 68, which is also connected to the upper end of section 62 of the collet.

The collet includes a plurality of fingers 70, two of which are shown in the drawings. The fingers have one end attached to section 58 of the collet and extend downwardly therefrom. The free end of each finger carries cam member or lug 72 of increased radial width. Each lug has inner surface 74 to engage ring or flange 76 on the mandrel to hold the lugs on the end of the fingers in the position shown in FIG. 5 when there are no forces acting on the collet tending to stretch or compress coil spring 66. Also in this position, inwardly extending cam members 78 on the fingers between lugs 72 and guide section 56 of the collet are positioned to engage flange or ring 80 on the mandrel. Cam members 78 have downwardly and outwardly inclined surfaces 82 that engage a similarly inclined surface 84 on ring or flange 80.

Figure 5:
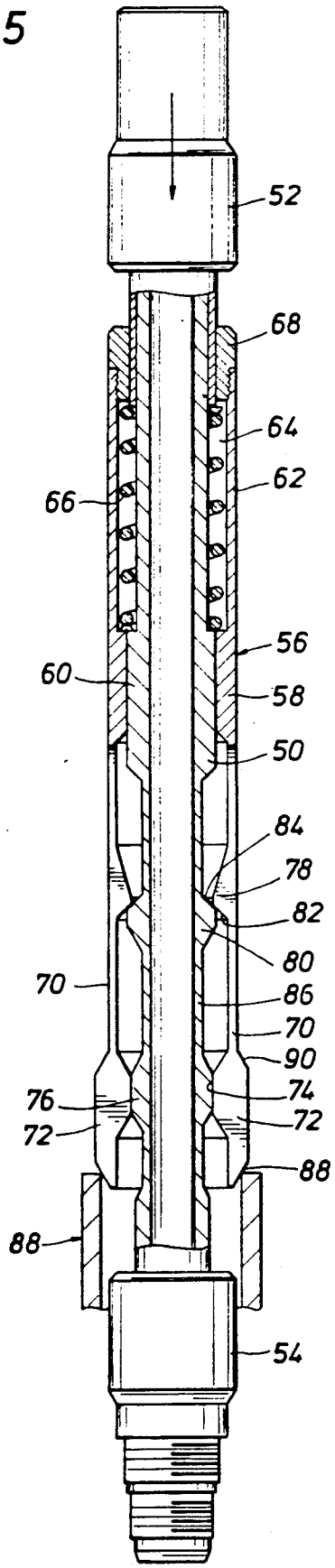
FIGS. 5–8 show the same views of an alternate embodiment of the locator of this invention as are shown in FIGS. 1–4.
Figure 6:
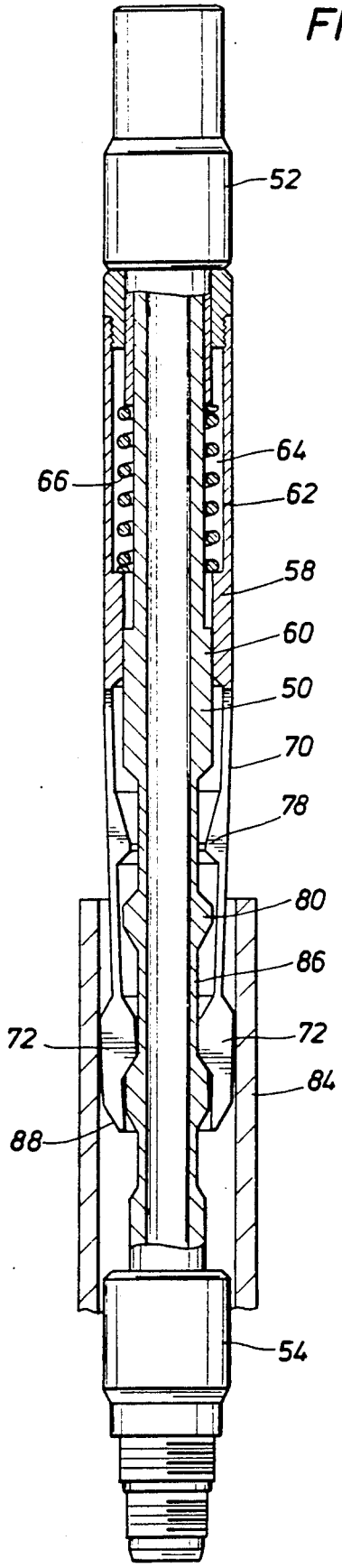

In the position shown in FIG. 5, lugs 72 will prevent the tool from entering well tubing 82. To move the lugs upwardly so that they will move off flange 76 and inwardly toward reduced diameter section 86 of the mandrel, a downward force is supplied to the tool sufficiently to compress spring 66 and allow the collet and the fingers to move upwardly until the lugs can move inwardly, as shown in FIG. 6, to a position adjacent section 92 of the mandrel and the tool can enter tubing 84. To facilitate this, the lower end of the lugs are provided with upwardly and outwardly extending tapers 88 which allows the tubing to cam the lugs inwardly toward the mandrel.

Figure 7:
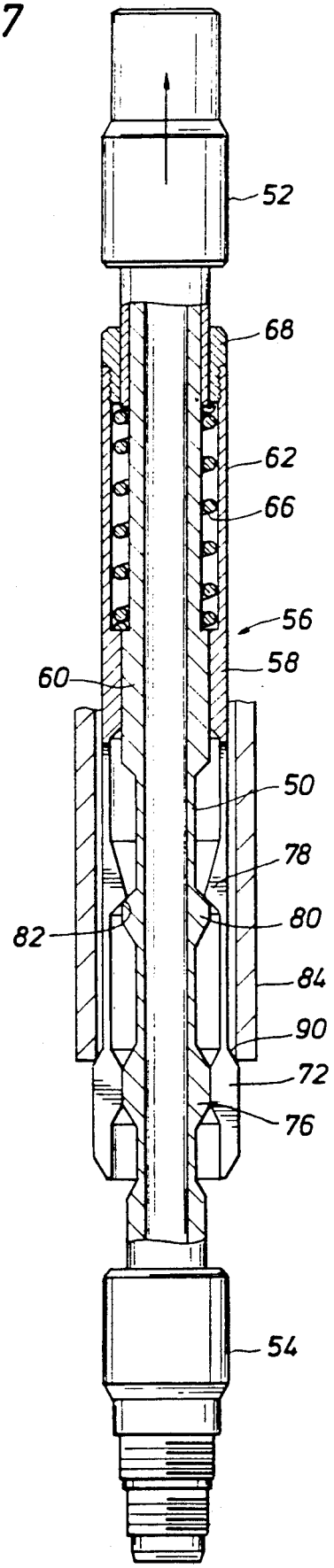

Once inside the tubing, the tool can be lowered through the tubing and out the lower end where the coil spring will move lugs 72 back to their position in engagement with surface 74 of flange 76, as shown in FIG. 7. Upward movement of the tool will now move inclined surfaces 90 into engagement with the lower end of the tubing and continued upward force exerted by the tubing to which the tool is connected will cause lugs 72 to move downwardly, placing tension in coil spring 66 until the lugs move below annular ring 76 and move inwardly toward section 92 of the mandrel, which is of reduced diameter, as shown in FIG. 8.

Some substantial upward force will be required to accomplish this, however, because as shown in FIG. 7, inwardly extending cam members 78 are in engagement with the inclined surface 84 of annular ring or flange 80 on the mandrel. Thus, sufficient force must be exerted to force lugs 78 outwardly far enough to clear annular ring 80 before the mandrel can move upwardly relative to the collet fingers to allow annular ring 76 to move out of engagement with surfaces 74 of lugs 72. When this occurs, the tool will be configured as shown in FIG. 8, and can enter tubing 84.

The substantial amount of force to accomplish this is the surface indication that the tool has engaged the lower end of the tubing. It may be desirable to check this several times which can be done simply by lowering the tool below the end of the tubing again, allowing it to resume the position shown in FIG. 5, then repeating the procedure of pulling the tool back into the tubing in the manner described above.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A tubing end locator comprising a mandrel, a collet carried by the mandrel having an annular base and a plurality of fingers having one end attached to the base and a free end extending from the base along the mandrel in parallel, spaced relationship, a lug on the free end of each finger, a flange on the mandrel having a diameter such that the lugs on the fingers will extend beyond the inside diameter of the tubing when the free ends of the fingers are in engagement with the flange, means for holding the fingers in engagement with the flange and for resisting the re-entry of the fingers into the tubing after the tubing end locator has passed out of the tubing until a substantial upward force has been exerted on the mandrel, thereby moving the flange of said mandrel out of engagement with the free ends of said fingers.

2. The tubing end locator of claim in which the holding means includes a cam member on the fingers and a cam member on the mandrel that hold the lug in position on the flange.

3. The tubing end locator of claim in which the holding means is a spring.

4. The tubing end locator of claim 3 further provided with second resilient means to resist the upward movement of the lugs when the tool enters the well tubing at the surface and to move the collet downwardly back into position with the lugs engaging the flange when the tool passes out of the well tubing.

5. The tubing end locator of claim 4 further provided with a sleeve located between the second resilient means and the lugs to urge the lugs inwardly when the lugs have been moved upwards out of engagement with the flange.

* * * * *